US005427460A

United States Patent [19]

Kajiya

[11] Patent Number: 5,427,460

[45] Date of Patent: Jun. 27, 1995

[54] LABEL PRINTER AND LABEL STRIP FEED MECHANISM THEREFOR

[75] Inventor: Hiroshi Kajiya, Tokyo, Japan

[73] Assignee: Kabushiki Kaisha Sato, Tokyo, Japan

[21] Appl. No.: 215,896

[22] Filed: Mar. 22, 1994

[30] Foreign Application Priority Data

Mar. 22, 1993 [JP] Japan ..... 5-018421 U
Mar. 22, 1993 [JP] Japan ..... 5-018427 U

[51] Int. Cl.[6] ..... B41J 1/00

[52] U.S. Cl. ..... 400/118.1; 400/247; 400/248; 156/541; 156/584; 342/220

[58] Field of Search ..... 400/118.1, 247, 248, 400/621; 156/540, 541, 542, 584, 384, 387; 346/76 PH

[56] References Cited

U.S. PATENT DOCUMENTS 4,481,518 11/1984 Iwui et al. ..... 400/248
4,739,341 4/1988 Matsuno et al. ..... 400/248
4,834,563 5/1989 Ozawa et al. ..... 400/247
5,188,469 2/1993 Nagao et al. ..... 400/621
5,259,681 11/1993 Kitazawa et al. ..... 400/584

FOREIGN PATENT DOCUMENTS 0237668 1/1986 Japan ..... 400/248
0306065 12/1988 Japan ..... 400/248
2161757 1/1986 United Kingdom ..... 400/248

*Primary Examiner*—Eugene H. Eickholt
*Attorney, Agent, or Firm*—Ostrolenk, Faber, Gerb and Soffen

[57] ABSTRACT

A label printer for receiving a continuous strip of labels on a backing strip from a label supply and for passing the labels between a thermal first head and a platen roller. A motor connected with the platen roller rotates the platen roller. A peeling rod located past the thermal head in the path of the backing strip about which the strip is sharply deflected for separating the labels from the backing strip. A rotatable presser roller opposite the platen roller and past the peeling rod for pressing the backing strip with the labels now removed against the platen roller, whereby the label strip is driven by the platen roller past the thermal head and the backing strip is driven by the rotation of the platen roller and the cooperating rotation of the presser roll again past the platen roller. The presser roll is supported by a support having positioning notches for selectively positioning the presser roll either engaging the platen roller or spaced from the platen roller, the latter position permitting threading of the strip member between those rollers. A spring normally urges the presser roller toward the platen roller. When the presser roller is supported in the support, it is held against the spring.

11 Claims, 6 Drawing Sheets

LABEL PRINTER AND LABEL STRIP FEED MECHANISM THEREFOR

BACKGROUND OF THE INVENTION

Field of the Invention

The present invention relates to a printer, and more particularly to an electronic printer used for printing a strip of labels temporarily attached on a continuous backing strip. The printer equipped with a presser roller that presses against a platen roller for feeding out a backing strip after labels that were removably attached at regular intervals to the backing strip have been peeled therefrom.

This invention further relates to a printer feed mechanism which issues labels by causing labels temporarily attached at regular intervals to a backing strip to be printed by a platen roller and a thermal head and to then be peeled off the backing strip by a label peeler.

Description of the Prior Art

FIG. 5 shows one prior art electronic printer having a printing mechanism comprising a thermal head 1 and a cooperating platen roller 2. An unprinted, continuous label strip 7 consisting of a backing strip 8 with a plurality of labels 9 temporarily attached thereon, e.g. by an adhesive, is held between the thermal head 1 and the platen roller 2 so that the head prints the labels as the continuous label strip 7 is fed past it.

After the labels are printed, the continuous label strip 7 is forwarded to a backing strip deflecting peeler rod 3 located past the printing mechanism in the backing strip path, and the rod 3 defines label peeling means. The backing strip 8 is turned sharply away from its surface carrying the labels at the peeler rod 3 which causes the stiffer labels 9 to peel off the backing strip. Only the turned back backing strip 8 is passed between a pair of feed rollers 4, 6 that are located below the platen roller 2 and that are rotated so as to feed the backing strip 8 downward. The fed out backing strip is either cut to appropriate lengths or is simply allowed to trail downward without being rolled.

The feed roller 6 is built into a detachable unit 5 which can be inserted into and removed from the body of the electronic printer. Before the electronic printer can be used, the backing strip 8 has to be passed between the feed rollers 4, 6. For this, it is necessary to draw the backing strip 8 to be below the feed roller 4 disposed inside the printer body, and to then attach the detachable unit 5 to the printer body in such manner that its feed roller 6 presses against the feed roller 4 with the backing strip 8 sandwiched between the two feed rollers.

The need to attach and detach the separate unit 5 including the feed roller 6 has made this prior art electronic printer troublesome to use. Moreover, since the backing strip feed rollers 4, 6 are provided separately of the platen roller 2 and have to be driven by a separate motor, this prior art electronic printer is large in size.

In a second prior art printer with feed mechanism shown in FIG. 8, a backing strip 107 having labels 101 temporarily attached thereon at regular internals is unwound from a supply reel 103 and is fed between a platen roller 104 and a thermal head 105 where the labels are printed. After that, the backing strip 102 is fed to and turned back around a peeler rod 106 at which the labels 101 are peeled off and are issued to the exterior of the printer. The labels 101 peeled off the backing strip 102 are either attached to the objects to be labeled (not shown) by hand or are supplied to a label attached (not shown). After wrapping over the rod 106, the backing strip 102 is either fed out continuously or is cut off at appropriate lengths.

In this conventional printer feed mechanism, the platen roller 104 is rotated by a stepping motor 107 which operates through a gear mechanism 108, 109 to convey the portion of the backing strip 102 held between the platen roller 104 and the thermal head 105, to unwind the backing strip 102 from the supply reel 103 and forward it to the peeler rod 106. After it passes over the peeler rod 106, the leading end of the backing strip 102 passes between a drive roller 110 and a presser roller 111 driven by the drive roller 110. The rotation of the drive roller 110 ensures that no slack develops in the backing strip 102 as it is fed over and turned back by the peeler rod 106. Since the labels 101 are stiffer than the backing strip 102, they peel off the backing strip 102 at the time that the backing strip 102 is turned back.

In recent years, there has been increasing emphasis on making products lighter and more compact, The above described prior art printer feed mechanism runs counter to this trend, however, since it requires as a power source for feeding labels not only the stepping motor 107 but also a motor for driving the drive roller 110. This makes the printer heavy and difficult to reduce in size.

SUMMARY OF THE INVENTION

The embodiments of the present invention were developed in light of the foregoing problems. The primary object of the invention is to provide an electronic printer with a simplified feed roller mechanism that can be manufactured at low cost.

Another object of the invention is to provide a printer feed mechanism which uses only a stepping motor as a power source for feeding labels and which also enables reduction in the number of feed rollers, thus making it possible to realize a light weight and compact printer.

The present invention provides a printer having a supply shaft from which a continuous strip consisting of a backing strip having labels temporarily attached thereon is supplied by winding the continuous strip onto the supply shaft and then later unwinding the strip from that shaft. A thermal head is provided on the feed path for the continuous strip. A platen roller is disposed opposite the thermal head. Label peeling means are provided on the feed path downstream of the thermal head for peeling labels from the continuous backing strip. A backing strip deflecting rod, or blade, or the like deflecting means may be used. Rotary presser means are positioned opposite the platen roller on the feed path of the backing strip downstream of the peeling means. Retaining means retain the rotary presser means. Support means support the rotary presser means. Urging means press the rotary presser means toward the platen roller. The support means are formed with means, e.g. at least one notch, for supporting the rotary presser means against the bias of the urging means to leave a space between the platen roller and the presser means. The rotary presser means are driven to rotate by the rotation of the platen roller. The presser means may be a separate roll.

When the electronic printer is to be set up for operation, the continuous label strip is passed between the thermal head and the platen roller to be held therebetween. The backing strip alone is turned back at the peeling means which are located downstream of the thermal head, and the turned back backing strip is drawn downward toward the platen roller. The rotary presser means, e.g. a presser roller is pulled away from the platen roller, against the force of the urging means, and is engaged in one of the notches of the presser roller support means so as to establish a gap between the presser roller and the platen roller. The backing strip is passed through the gap. The presser roller is then moved to another notch of the presser roller support means so as to return the presser roller toward the platen roller and to permit the urging means to cause the presser roller to press against the platen roller with the backing strip caught between the presser roller and the platen roller.

After the backing sheet has been set in the foregoing manner, the platen roller is rotated by a motor. This continuously draws unprinted label strip off the supply shaft and feeds it to the thermal head. The thermal head and the platen roller print prescribed information on the labels fed between them. The printed labels are then fed out further downstream of the label peeling means, where the labels are peeled off the backing strip. Only the backing strip is turned back around the peeling means. The turned back backing strip, which is caught between the platen roller and the presser roller, is fed downward by the rotation of the platen roller and by the rotation of the presser roller driven by the platen roller.

A second embodiment of a printer feed mechanism for a label printer passes a backing strip having labels temporarily attached thereon between a thermal head and a platen roller which constitute a printing section for printing the labels. The backing strip is forwarded from the printing section toward peeling means by rotation of the platen roller. The backing strip is turned back by the peeling means for peeling the printed labels off the backing strip. The printer feed mechanism comprises a presser roller which is located opposite the platen roller for pressing against the platen roller and for being rotated thereby. The backing strip which is fed out from the printing section and is turned back by the peeling means is passed between and fed by the platen roller and the presser roller.

The presser roller presses onto the platen roller and is driven to rotate by the rotation of the platen roller. The backing strip being fed out from the printing section passes by the peeling means to move between the platen roller and the presser roller. As a result, when the platen roller is rotated, the part of the backing strip whose labels have been printed at the printing section is fed to the peeling means at a prescribed feeding speed. At the same time, the presser roller pressed against the platen roller through the backing strip is rotated by the rotation of the platen roller so as to feed the backing sheet, which is fed out from the printing section, at the same prescribed feeding speed. Since the backing strip fed out from the printing section is therefore fed to and turned back by the peeling means without developing any slack, the labels can be reliably peeled off the backing strip.

The printer feed mechanism according to this invention thus requires only the stepping motor as a power source for feeding labels. It does not require a drive roller and a motor for driving a drive roller, as is necessary in prior art label printer feed mechanisms. It therefore enables the printer in which it used to be made light and compact.

Other features and advantages of the present invention will become apparent from the following description of the invention which refers to the accompanying drawings.

DESCRIPTION OF THE PREFERRED EMBODIMENTS

Figure 1:
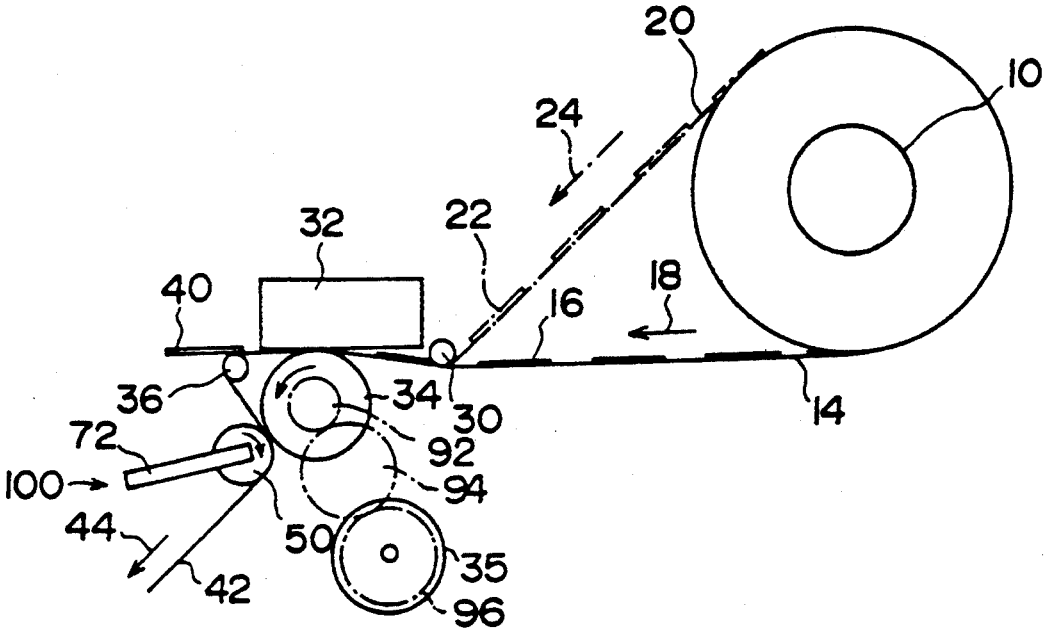
FIG. 1 is a schematic side view of an electronic printer according to one embodiment of the invention.

A first embodiment of the present invention is now explained with reference to FIGS. 1 to 4. FIG. 1 schematically shows the overall configuration of the electronic printer. The printer includes a supply shaft on which a continuous label strip 14 is wound, a thermal print head 32, a platen roller 34 disposed opposite the thermal head 32, a peeler rod 36 positioned beyond the thermal head 32, and a presser roller 50 positioned below the peeler rod 36 and movable for pressing against the platen roller 34.

The continuous strip 14 (or 20) is comprised of a backing strip 42 and a plurality of labels 16 (or 22). The labels 16 (or 22) are coated on one side with an adhesive and are temporarily attached to the backing strip 42 at regular intervals. When the continuous strip 14 is wound on the supply shaft 10 with the labels 16 facing inward, the strip 14 is paid off for printing in the direction indicated by the arrow 18. On the other hand, when the continuous strip 20 is wound on the supply shaft 10 with the labels 22 facing outward, it is paid off for printing in the direction indicated by the arrow 24. The following explanation is based on the assumption that the continuous strip 14 is wound with the labels facing inward.

The thermal head 32 and the platen roller 34 constitute a printing section. The platen roller 34 is driven to rotate by a motor 35 via a gear 96 provided on the shaft of the motor 35, an intermediate gear 94 and a gear 92 provided on the shaft of the platen roller 34.

In the illustrated embodiment, the peeling means for turning back the backing strip 42 is the peeler rod 36 located past the head 32. However, the peeling means is not limited to this arrangement, and the peeling means may instead comprise a member formed with a sharp or angular edge about which the backing strip is deflected.

Figure 2:
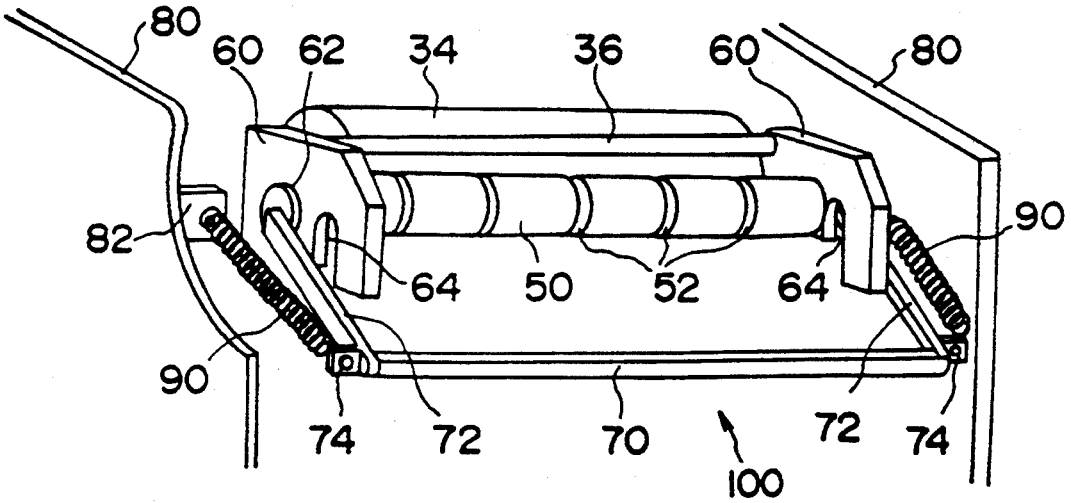
FIG. 2 is an enlarged view of the presser mechanism of the electronic printer of FIG. 1.
Figure 3:
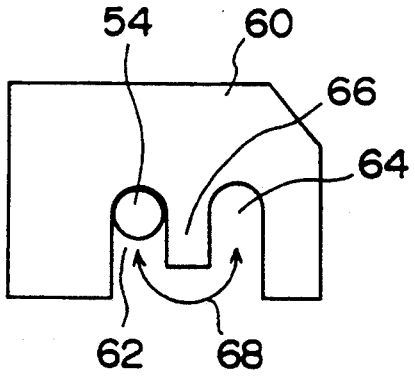
FIG. 3 is a side view of one example of a support frame for supporting the presser roller of the electronic printer of FIG. 1.

FIG. 2 is an enlarged partial view showing how the presser roller 50 is pressed onto the platen roller 34 for grasping the backing strip 42. As shown in FIGS. 2 and 3, the presser roller mechanism is comprised of the presser roller 50, the shaft 54 of the presser roller 50, a retaining arm or bracket of generally U-shape and comprised of long arm 70 and short arms 72 for retaining the presser roller, a pair of support frames 60 for supporting the presser roller 50, and a pair of springs 90 attached to the opposite ends of the long arm 70.

The presser roller 50 is formed of an elastic material such as resin or rubber. A plurality of small grooves 52 are formed around its periphery spaced from one another along the longitudinal direction of the presser roller 50. The presser roller 50 can be rotated in either direction, forward or reverse.

The lower edge of the long arm 70 of the retaining bracket forms a cutter for cutting the backing strip 42 that has passed between the platen roller 34 and the presser roller 50. Each short arm 72 of the bracket is fixed at one end to one end of the long arm 70 and at its other end to the shaft 54 of the presser roller 50. The long arm 70 and the short arms 72 of the bracket can be formed separately or integrally with each other.

Each spring 90 is attached at one end to a lug 82 provided on a side plate 80 of the electronic printer body and at the other to one end of the long arm 70. The two springs 90 cooperate as urging means to urge the presser roller 50 toward the platen roller 34.

FIG. 3 shows a side view of one of the support frames 60. The support frames 60 are built into and engage the side plates 80. As shown in FIG. 3, the support frames 60 are formed with notches 62, 64 for enabling the shaft 54 of the presser roller 50 to be switched between two support positions. The notch 62 positions the presser roller 50 to press against the platen roller 34, with the backing strip 42 caught between the two rollers. The notch 64 positions the presser roller 50 to establish a gap for passage of the backing strip 42 between the presser roller 50 and the platen roller 34 when the printer is being set up for operation. The distance between the notch 62 and 64 need only be large enough to establish a gap for enabling easy passage of the backing strip 42 between the platen roller 34 and the presser roller 50. The depth of the notches 62 should be adequate for retaining the shaft 54 of the platen roller 34.

Figure 4:
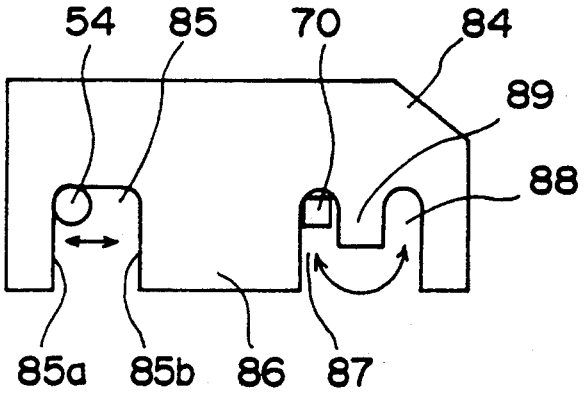
FIG. 4 is a side view of another example of a support frame for supporting the presser roller of the electronic printer of FIG. 1.
Figure 5:
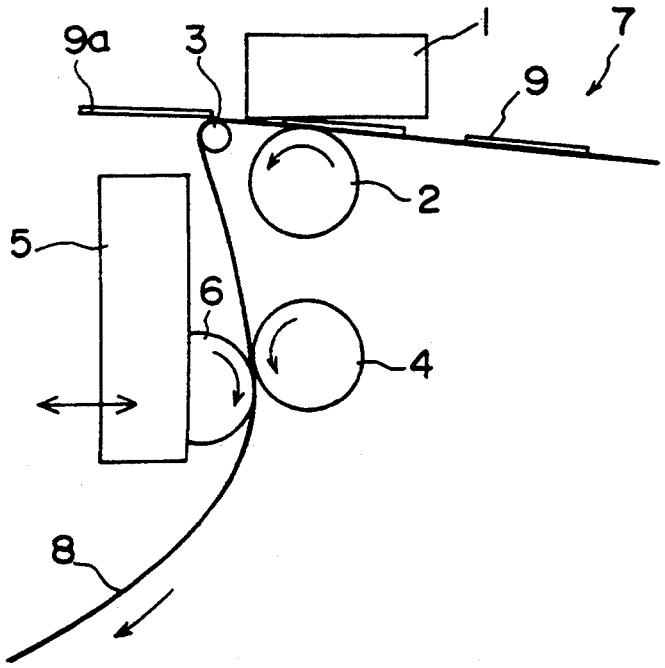
FIG. 5 PRIOR ART
FIG. 5 is schematic view of a prior art printer.

FIG. 4 is a side view of another example of a support frame 84. The support frame 84 has a notch 85 for retaining the shaft 54 and two notches 87, 88 for retaining the retaining bracket arms 70, 72. When the presser roller 50 is pressed against the platen roller 34, the presser roller shaft 54 is positioned at one end **85*a* of the notch 85 and the long arm 70 of the retaining bracket is retained in the notch 87. When the presser roller 50 is separated from the platen roller 34, the presser roller shaft 54 is positioned at the other end 85*b* of the notch 85 and the long arm 70 of the retaining bracket is moved to and retained in the notch 88**.

The length of the protrusion 86 between the notch 85 and the notch 87 is based on the length of the short arms 72 of the retaining bracket.

The operation of the first embodiment of the invention is now explained.

During initial setup, the thermal head 32 is released from the platen roller 34 to establish a gap between them. The long arm 70 of the retaining bracket to which the presser roller 50 is attached is then pulled forward in FIGS. 1 and 2 against the force of the springs 90 for separating the presser roller 50 from the platen roller 34 and retaining the shaft 54 of the platen roller 34 in the notches 64 formed in the support frames 60 at positions more distant from the platen roller. This establishes a gap between the platen roller 34 and the presser roller 50.

Next, the continuous strip 14 which is wound on the supply shaft 10 is paid out by hand and passed through the gap between the thermal head 32 and the platen roller 34. The continuous strip 14 is then paid out further and the backing strip 42 is turned back at the peeler rod 36 and is passed through the gap between the platen roller 34 and the presser roller 50.

Following this, the thermal head 32 is returned to its position nearer the platen roller 34 so as to catch the continuous strip 14 between the thermal head 32 and the platen roller 34, and the presser roller shaft 54 is moved from the notch 64 to the notch 62 nearer to the platen roller so as to press the presser roller 50 against the platen roller 34 and clamp the backing strip 42.

After these preparations, the motor 35 is started, which rotates the platen roller 34 via the intermediate gear 94. The resulting rotation of the platen roller 34 feeds the continuous strip 14 through the printing section comprised of the thermal head 32 and the platen roller 34 so that the labels 16 are printed in the prescribed manner. The printed labels 40 are peeled off by the peeler rod 36. The backing strip 42, now stripped of the printed labels 40, is held between the platen roller 34 and the presser roller 50 and is thereby further fed along a downstream backing strip feed path.

Since the invention provides a simple mechanism for feeding out backing strip after the printed labels have been peeled off, the printer can be made compact and low in cost.

Figure 6:
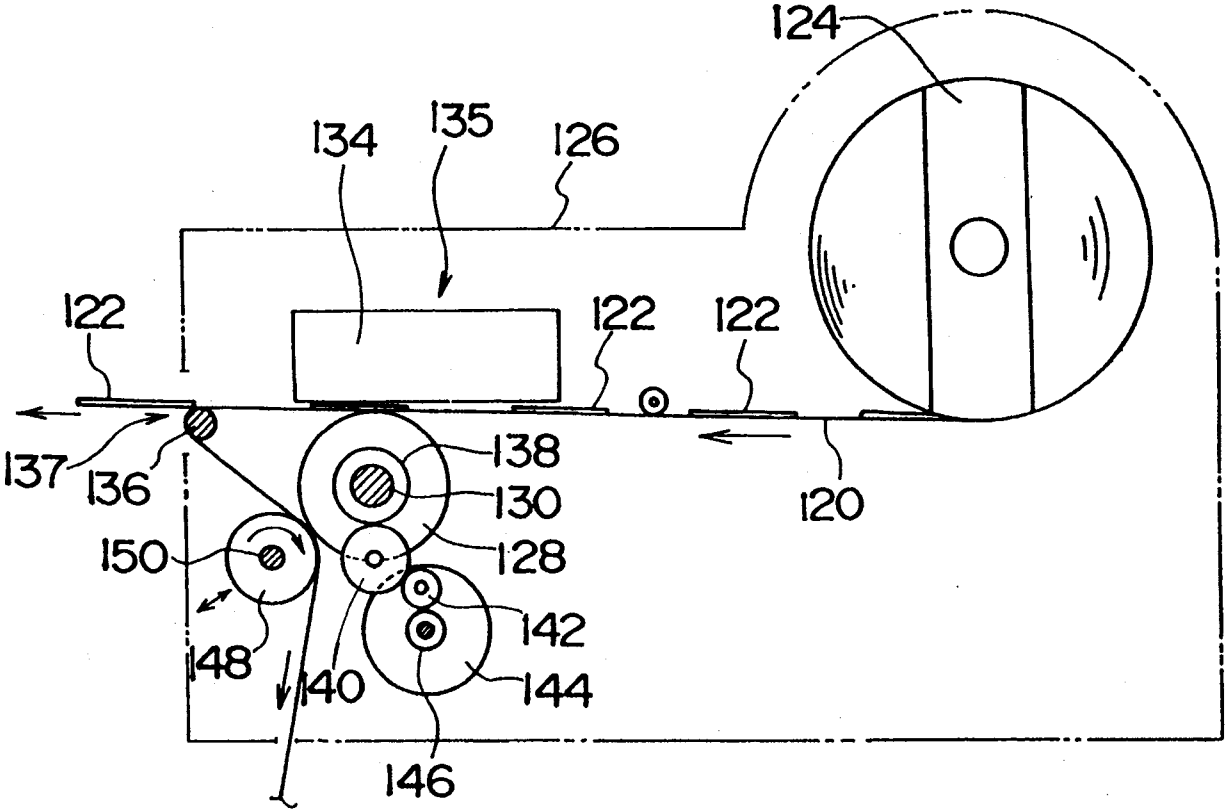
FIG. 6 is a side view showing a second embodiment of the printer feed mechanism according to the present invention.

A second preferred embodiment of the printer feed mechanism according to the present invention is shown in FIG. 6. The printer is adapted to issue printed labels by printing required information on labels 122 which are temporarily attached to a backing strip 120 and then peeling the printed labels 122 off the backing strip 120. For enabling this operation, the printer is equipped with a supply reel 124 for holding a label strip roll comprised of a continuous backing strip 120 having labels 122 temporarily attached at regular intervals thereon, a printing section 135 for printing the labels 122, a peeling section 137 for peeling the labels 122 printed by the printing section 135 off the backing strip 120, and a feed mechanism for feeding the backing strip 120 along a prescribed feed path.

Figure 7:
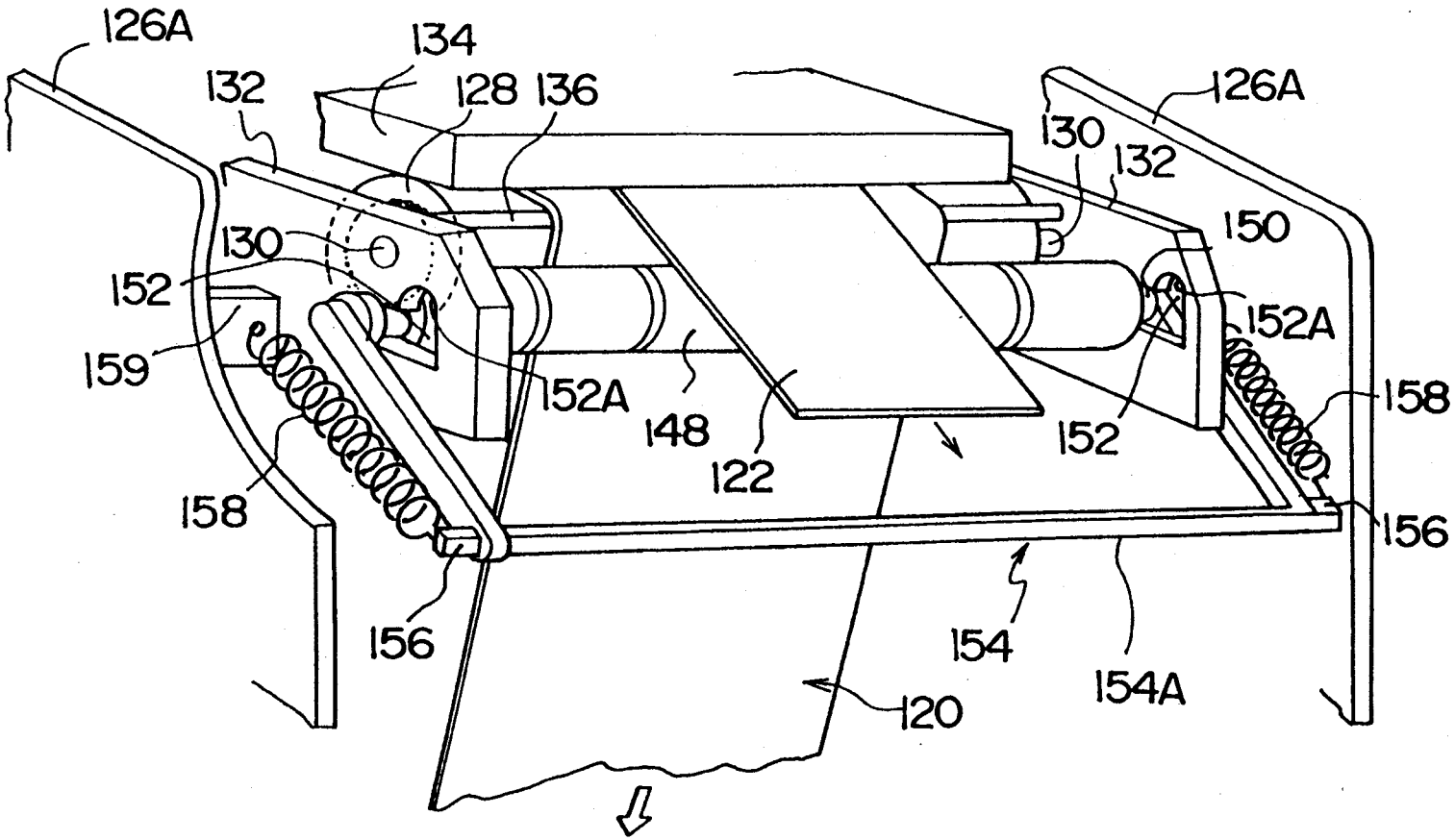
FIG. 7 is a perspective view of an essential portion of the embodiment of the printer feed mechanism shown in FIG. 6.
Figure 8:
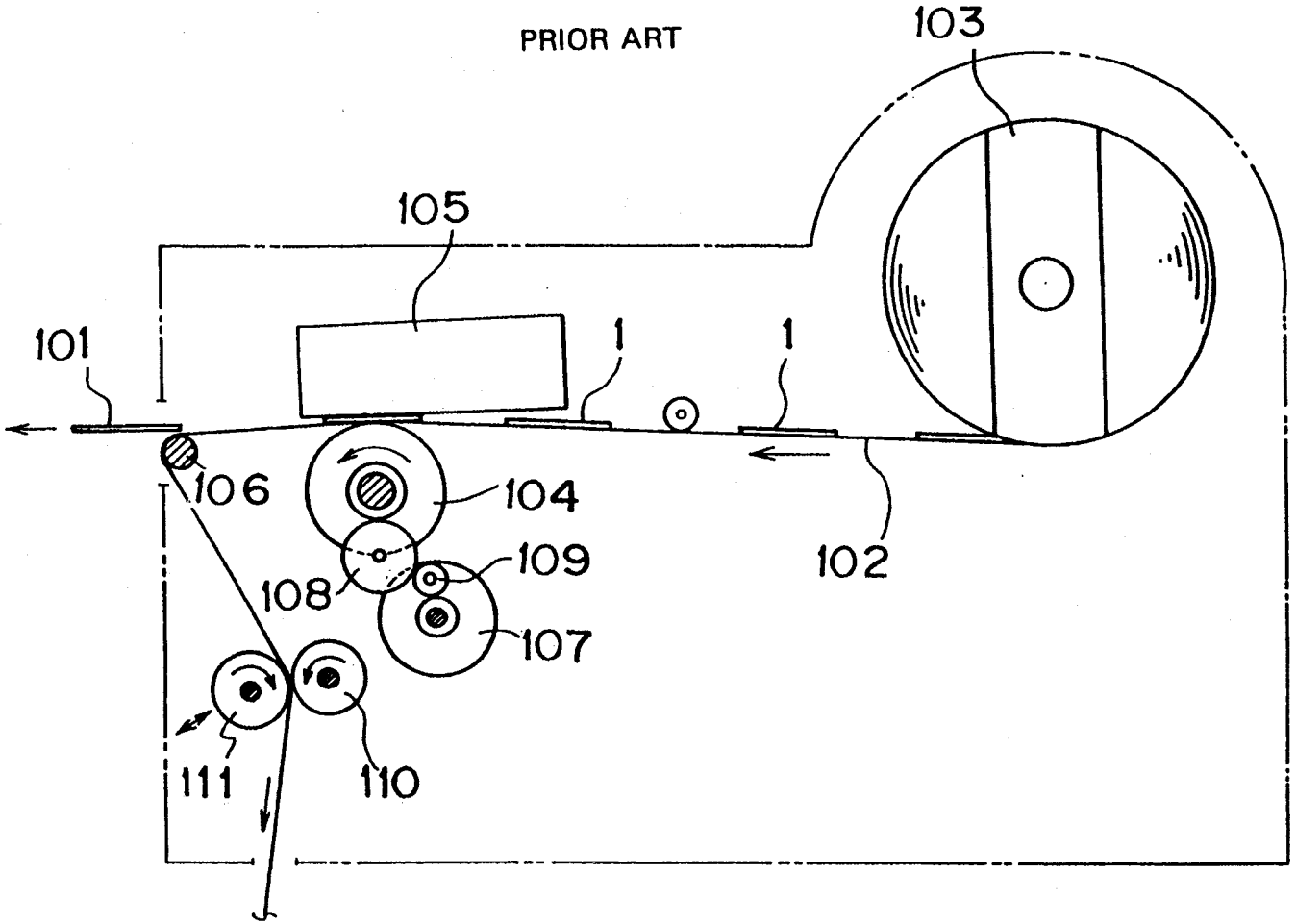
FIG. 8 PRIOR ART
FIG. 8 is a side view showing a second prior art printer and feed mechanism.

In FIGS. 6 and 7, the printing section 135 includes a platen roller 128 having a rotary shaft 130 which is rotatably supported at opposite ends by a pair of vertically disposed support plates 132 which mount the platen roller 128 horizontally inside the printer body 126. A thermal head 134 is mounted directly above the platen roller 128 and applies a prescribed amount of pressure thereon. The backing strip 120 unwound from the supply reel 124 is held between the platen roller 128 and the thermal head 134 for printing the labels 122 as required.

The peeling section 137 is comprised of a peeler rod 136 which is fixed at its opposite ends to the support plates 132 and is positioned horizontally near the downstream end of the printing section 135. The feed direction of the portion of the backing strip 120 whose labels have been printed by the printing section 135 is turned back by the peeler rod 136. This causes the labels 122, which are stiffer than the backing strip 120, to be peeled off the backing strip 120 when the backing strip 120 is turned back at the peeler rod 136.

The feed mechanism for feeding the backing strip 120 along the feed path is now explained.

A gear 138 fitted on one end of the rotary shaft 130 of the platen roller 128 is linked with a gear 146 of a stepping motor 144 through first and second gears 140, 142. A presser roller 148 has a rotary shaft 150 with opposite ends that pass through elongate holes 152 formed in the support plates 132, where they are supported by the opposite ends of a bracket or U-shaped arm 154 so as to press the presser roller 148 against the platen roller 128 from the side of the roller 128 nearer the peeler rod 136. When the stepping motor 144 is operated, its intermittently applied power is thus transmitted through the first and second gears 142, 140 to the platen roller 128 to rotate the platen roller 128 and in turn to cause the presser roller 148 driven by the platen roller 128 to rotate.

A projection 156 extends outward from both ends of the base of the bracket arm 154. A spring 158 is connected between the projection 156 and a lug 159 projecting from the inside wall 126A of the printer body 126. The ends of the elongate holes 152 closer to the arm 154A of the bracket arm 154 are notched upward to form retaining notches 152A. The presser roller 148 can be spaced from the platen roller 128 by pulling the arm 154A and allowing the ends of the rotary shaft 150 to catch in the retaining notches 152A. When the ends of the rotary shaft 150 of the presser roller 148 are later released from the retaining notches 152A, the spring 158 pulls the presser roller 148 back into contact with the platen roller 128.

The operation of this printer feed mechanism is now explained. Prior to the start of printing, the leading end of the backing strip 120 wound on the supply reel 124 is passed between the platen roller 128 and the thermal printer 134 which define the printing section 135, is passed around the peeler rod 36 and is then passed between the platen roller 128 and the thermal printer 134, thereby forming a slack free feed path for the backing strip 120. For facilitating the threading of the backing strip 120, the arm 154A is pulled forward against the force of the spring 158 so that the ends of the rotary shaft 150 of the presser roller 148 can catch in the retaining notches 152A. This establishes a gap between the platen roller 128 and the presser roller 148.

After the backing strip 120 has been passed through the gap, the presser roller 148 is returned to pressure contact with the platen roller 128 with the backing strip 120 sandwiched in between. The stepping motor 144 is then put into operation for rotating the platen roller 128. The rotation of the platen roller 128 unrolls the backing strip 120 from the supply reel 124 and draws it into the printing section 135 so that the platen roller 128 can cooperate with the thermal printer 134 to print the labels 122 as required. The portion of the backing strip 120 with the printed labels on it is then moved forward toward the peeler rod 136 at a prescribed feeding speed.

Simultaneously, the presser roller 148 pressed against the platen roller 128 through the backing strip 120 between them is also rotated by the rotation of the platen roller 128 so that the backing strip 120 being fed out from the printing section 135 is again fed between the rollers 128, 148 at the same prescribed feeding speed. Since the backing strip 120 fed out from the printing section 135 is therefore fed to and turned back at the peeler rod 136 in a slack free tensioned state, the labels 122 can be reliably peeled off the backing strip 120. The labels 122 peeled off the backing strip 120 are either attached to objects to be labeled by hand or are supplied to a separate label attacher. The backing strip 120 free of the labels 122 is either fed out continuously or cut off at appropriate lengths.

Since the printer feed mechanism according to the present invention is configured such that the presser roller 148 is pressed onto the platen roller 128 for enabling the platen roller 128 and the presser roller 148 to cooperatively feed the backing strip 120 out from the printing section 135, the printer requires only the stepping motor 144 as a power source for label feeding. Since the drive roller and the motor for driving the drive roller used in prior art printer feed mechanisms are therefore unnecessary, the printer can be reduced in both weight and size.

Although the invention was described with reference to an embodiment that uses a gear mechanism as the power transmission means for the stepping motor 144, it is alternatively possible to use belt or other power transmission means.

Although the printer feed mechanism according to the invention was explained with reference to the feeding of a backing strip having temporarily attached labels, it can also be used for feeding tags, plain paper, and the like.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A printer including a feed mechanism for a label strip, wherein the label strip to be fed comprises a continuous backing strip having labels temporarily attached along one side of the backing strip;

the printer comprising:

means for supplying the continuous backing strip with labels on it to the printer;

a thermal head positioned for the backing strip with labels thereon to be supplied to the head by the supply means and for thermally printing the labels then attached to the backing strip;

a platen roller disposed opposite the thermal head such that the backing strip with labels on it passes between the thermal head and the platen roller and the thermal head thermally prints the labels by pressing on the labels and backing strip against the platen roller;

label peeling means located past the thermal head on the path of the continuous backing strip from the backing strip supply for there peeling the temporarily attached labels from the backing strip by redirecting the backing strip from its direction of movement past the peeling means and back toward the platen roller;

rotary presser means positioned opposite the platen roller and engageable with the platen roller at a location on the platen roller past the location thereon which cooperates with the thermal head, for receiving the continuous strip between the rotary presser means and the platen roller after the backing strip has passed the label peeling means;

urging means for urging the rotary presser means toward the platen roller for engaging the backing strip between the rotary presser means and the platen roller such that rotation of the platen roller moves the continuous strip member with labels thereon past the thermal head and the platen roller, then moves the backing strip past the peeling means and then moves the backing strip past the presser means and the platen roller.

2. The printer and feed mechanism of claim 1, further comprising the rotary presser means comprising a presser roller located opposite the platen roller for pressing against the platen roller and for being rotated by the platen roller, such that rotation of the platen roller moves the continuous backing strip with labels on it past the thermal head and moves the backing strip past the platen roller.

3. The printer of claim 1, further comprising means for driving the platen roller to rotate.

4. The printer of claim 3, wherein the driving means for the platen roller comprises a stepping motor and means connecting the stepping motor to the platen roller for rotating the platen motor in a stepped fashion for enabling the thermal head to thermally print the labels on the backing strip.

5. The printer of claim 1, further comprising support means for supporting the rotary presser means against the action of the urging means, the support means including means for establishing a first position of the presser means spaced away from the platen roller and a second position of the presser means at the platen roller.

6. The printer of claim 5, wherein the means for establishing a first position of the support means includes at least one notch in the support means for engaging the rotary presser means for supporting the rotary presser means spaced away from the platen roller.

7. The printer of claim 6, further comprising a second notch in the support means positioned for receiving the rotary presser means and permitting the rotary presser means to be moved by the urging means to engage the platen roller.

8. The printer of claim 1, wherein the means for supplying a continuous backing strip with labels comprises a support on which the backing strip with labels is wound and from which the backing strip is wound off by the platen roller moving the backing strip past the thermal head.

9. The printer of claim 1, wherein the urging means comprises a spring normally biasing the rotary presser means toward the platen roller; and the support means being operable for holding the presser means against the urging of the spring and in position with the pressing means off the platen roller.

10. The printer of claim 1, wherein the rotary presser means is engaged by the platen roller for being driven to rotate by the platen roller.

11. The printer of claim 1, further comprising means for driving the rotary presser means to rotate along with the platen roller.

* * * * *